US005111606A

United States Patent [19]

Reynolds

[11] Patent Number: 5,111,606

[45] Date of Patent: May 12, 1992

[54] AT-SHELF LIGHTED MERCHANDISING DISPLAY

[76] Inventor: Randy B. Reynolds, 2194 E. Country View La., Salt Lake City, Utah 84121

[21] Appl. No.: 536,765

[22] Filed: Jun. 11, 1990

[51] Int. Cl.[5] ..... G09F 3/18

[52] U.S. Cl. ..... 40/642; 40/152.2

[58] Field of Search ..... 40/642, 649, 650, 584, 40/442, 553, 658, 152.2, 597, 618, 570; 362/125, 184, 191, 234; D20/41, 10

[56] References Cited

U.S. PATENT DOCUMENTS

| | | | |
|---|---|---|---|
| D. 243,639 | 3/1977 | Escalante | D20/10 |
| D. 245,945 | 9/1977 | Mihojevich | D20/3 |
| 900,590 | 10/1908 | Raymond | 40/575 |
| 2,541,303 | 2/1951 | Smith | 40/618 X |
| 2,924,902 | 2/1960 | Luck et al. | 40/649 X |
| 3,041,760 | 7/1962 | Slavsky | 40/642 |
| 3,070,911 | 1/1963 | Slavsky | 40/642 |
| 3,084,463 | 4/1963 | Guyer et al. | 40/564 |
| 3,517,937 | 6/1970 | Glass et al. | 40/152.2 X |
| 3,931,689 | 1/1976 | Shine | 40/570 |
| 4,096,656 | 6/1978 | Dicegue | 40/152.2 |
| 4,317,303 | 3/1982 | Sernovitz | 40/564 |
| 4,805,331 | 2/1989 | Boggess et al. | 211/59.2 X |
| 4,819,353 | 4/1989 | Gluckman et al. | 40/152.2 |
| 4,881,707 | 11/1989 | Garfinkle | 40/642 X |
| 4,924,363 | 5/1990 | Kornelson | 40/442 X |
| 4,984,693 | 1/1991 | Belokin, Jr. et al. | 248/206.3 X |

FOREIGN PATENT DOCUMENTS

| | | | |
|---|---|---|---|
| 469487 | of 1914 | United Kingdom | 40/597 |

*Primary Examiner*—Kenneth J. Dorner
*Assistant Examiner*—Brian K. Green
*Attorney, Agent, or Firm*—M. Ralph Shaffer

[57] ABSTRACT

An at-shelf lighted merchandising display device for selective attachment to and/or proximate positioning with respect to a shelf containing merchandise. The display device is constructed for receipt of one or more advertising cards, disposed in suitable pockets, with the peripheral edge and/or peripheral margins of the panel containing lights which are energized, e.g., by a battery. The battery is enclosed in the case or is encased in a mounting clip to be secured proximate the merchandise shelf. The panel includes flexible tab or tongue for accommodating any inadvertent jarring of the panel as by shoppers and their carts. In one form of the invention the resilient flexible tab employed interconnecting the panel with the mounting clip of the device also carries the electrical circuit leads powering the lights of the panel.

3 Claims, 3 Drawing Sheets

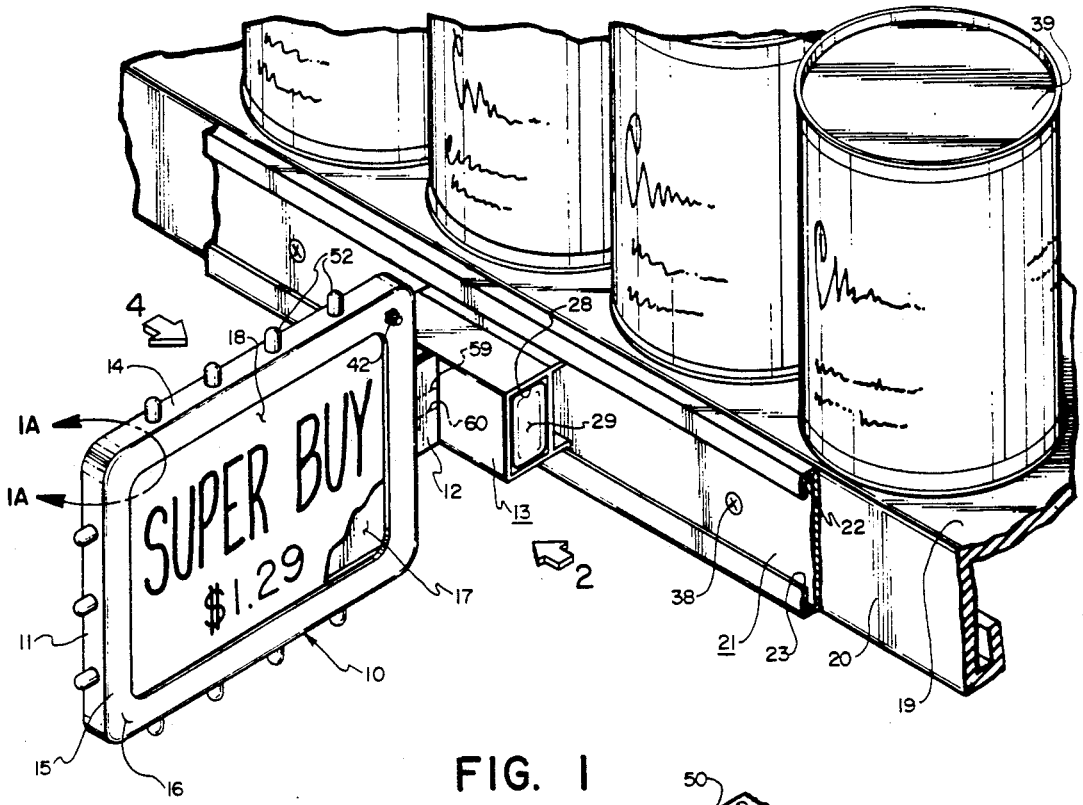
FIG. 1
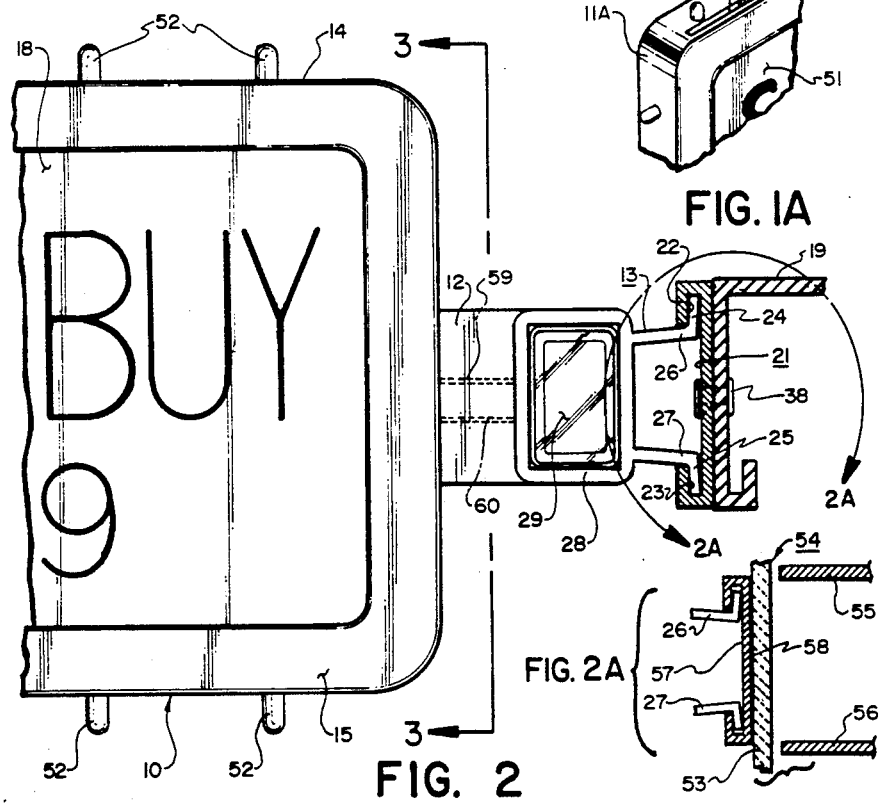
FIG. 2
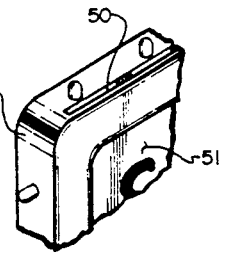
FIG. 1A
FIG. 2A
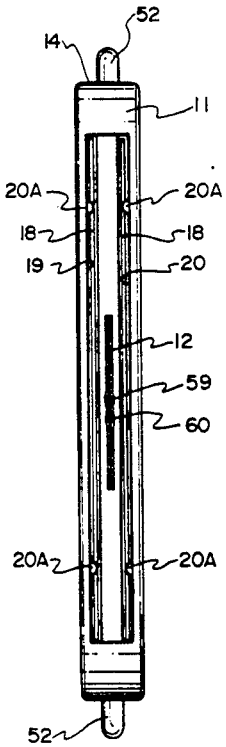
FIG. 3

AT-SHELF LIGHTED MERCHANDISING DISPLAY

FIELD OF INVENTION

The present invention relates to on-site merchandising displays and, more particularly, provides an at-shelf lighted merchandising display device of unique construction, the device being suitable for releasable connection to the channel of the display shelf or other and proximate structure.

DESCRIPTION OF PRIOR ART

In the past a number of different types of approaches have been taken in advertising merchandise carried on grocery store shelves, by way of example. Advertising media are important, of course, to draw the attention of shoppers to various specials, new items, and featured items for a particular sale period.

The present invention, comprising an on site, proximate lighted advertising display, usable for releasable attachment to a store shelf or the transparent door of a cabinet such as a refrigerated soft drink cabinet, is believed entirely new. Frequently electrical outlets are inaccessible and, therefore, it is important in the present invention that the advertising display carry its own electrical battery. The electrical circuit is provided with on/off switch means, generally of the push button character, to eliminate battery drain during unwanted hours such as during nighttime. Of importance is that the display herein includes some type of a flexible mount so that shoppers and shopping carts bumping into the display will not damage the same; rather, in the present invention the flexible tab mount, which preferably also includes the electrical circuit leads, is resilient and flexible so that the panel of the advertising display after any impact will spring back to a normal or perpendicular condition relative to the structure to which it is mounted.

No art or teaching is known wherein on-site, proximate-shelf advertising displays carry lighting faculty. Special provisions are needed for this faculty in, for example, the inclusion of the battery in the spring clip mount supplied the unit; another way of accommodating electrical powering of the advertising device is to include the battery actually in the frame of the panel, comprising a major portion of such device. The device needs to be made such that the lighting circuit does not interfere with advertising card removal and replacement; in this connection one preferred form of the invention includes at least one and preferably a pair of pockets receiving respective advertising cards, a central portion being provided with a flexible tab which carries electrical circuit means to the spring clip provided for attachment to an external store shelf.

The following patent art is known and is noted: U.S. Pat. Nos. 2,654,172; 2,817,131; 3,226,866; 3,696,541; 4,028,828; 4,055,014; 4,682,430.

None of these patents, taken singly or in combination, teaches the concept of incorporating a proximate-shelf advertising or merchandising display device wherein the same includes its own self-contained battery-power, this for the purpose of energizing lights of the panel. Nor is there taught the concept of incorporating lighting means in combination with structural flexiblity so that neither the lights nor the panel containing the same are damaged during grocery cart impact, for example. Finally, in one embodiment of the invention, and not shown in the prior art, is the concept of a battery container of unique design which is self-contained or proximate to and integral with the mounting clip of the device.

BRIEF DESCRIPTION OF THE INVENTION

In accordance with the principles of the present invention, and which do avoid the prior art as above recited, the present invention provides a panel having one or more pockets for receiving advertising cards or displays, such panel also including a series of edge or edge mounted lights. An electrical circuit accommodates such lights. These lights either flash on or off of their own accord and design, as in common practice with Christmas tree lights, for example, or they may be powered by an independent flasher unit to accommodate light emission interruption. An on/off switch is provided so that the light portion of the display can be turned off at nightime. The panel includes a resilient and flexible tongue or tab which offers an articulative character or flexibility relative to the mounting of the device to the store shelf or other object, this so that impact by shopping carts, shoppers and the like as to the display will not damage the display or remove the same from its mounting.

In one form of the invention the device includes an adaptor whereby the same can be conveniently cemented to or otherwise secured to the transparent door of a display cabinet such as a soft drink cabinet. The battery itself is contained in a unique container or housing which facilitates easy removal of the battery and yet a substantial hiding of the battery from view by virtue of the same being self-contained within the mounting clip of the device. As an alternative means for supplying battery power, the battery can be employed directly in the frame of the panel of the advertising device, thus leaving the mounting clip free of internal structure whereby the legs can spring upwardly into a channel designed for their engagement.

Even though in one embodiment the battery, as one source of power, is somewhat hidden from view and inaccessible, yet provision is made so that an implement such as a pen or pencil may be used to eject the battery from its case and allow for replacement or recharging thereof. Suitable lighting means including incandescent lights, LEDs (light emitting diodes), and high intensity discharge lights (HIDs) can be employed, with or without concave reflectors such as parabolic reflectors for the individual light elements.

OBJECTS

Accordingly, a principal object of the present invention is to provide a new and improved advertising display device for use at or proximate to a store shelf.

A further object of the invention is to provide a at-shelf lighted merchandising display device wherein the same includes a flexible mount, appropriate peripherally mounted separated lighting means, this powered by a battery disposed either in the frame or panel of the device or within the interior of the mounting clip thereof.

An additional object is to provide a lighted merchandising display device wherein the same self-contains its own source of power, i.e. a battery, this to accommodate the electrical powering of lights disposed at or proximate to the peripheral edge of the devices main panel.

An additional object is to provide a merchandising display device having one or more pockets for receiving advertising cards and, in combination therewith, an electrical circuit including a series of mutually spaced lights arranged so as not to interfere in placement or removal of such advertising cards.

A further object is to provide a lighted merchandising display device wherein advertising cards incorporated therein can be inserted from the inner edge of the device, this by flexing the principal panel of the device in accordance with allowance made by the tab attachment to its bracket, whereby the device can be urged either forwardly or rearwardly to expose the entrances to the pockets designed to receive such advertising cards.

BRIEF DESCRIPTION OF DRAWINGS

The present invention, both as to advantages and further objects thereof, may best be understood by reference to the following detailed description taken in conjunction with the accompanying drawings in which:

FIG. 1 is a fragmentary perspective view of a shelf incorporating the display device of the present invention.

FIG. 1A is an enlarged fragmentary detail of the display device of FIG. 1 wherein the same contains a single card receiving slot.

FIG. 2 is an enlarged fragmentary elevation taken along the arrow 2 in FIG. 1.

FIG. 2A is a detail taken along the arcuate line 2A—2A in FIG. 2, illustrating that the attachment construction of the display device may be modified so that the same can be adapted for direct attachment to the front panel of the glass door of a display cabinet, a fragmentary detail of a portion of which is shown.

FIG. 3 is a vertical section taken along the line 3—3 in FIG. 2.

DETAILED DESCRIPTION OF PREFERRED EMBODIMENTS

Figure 4:
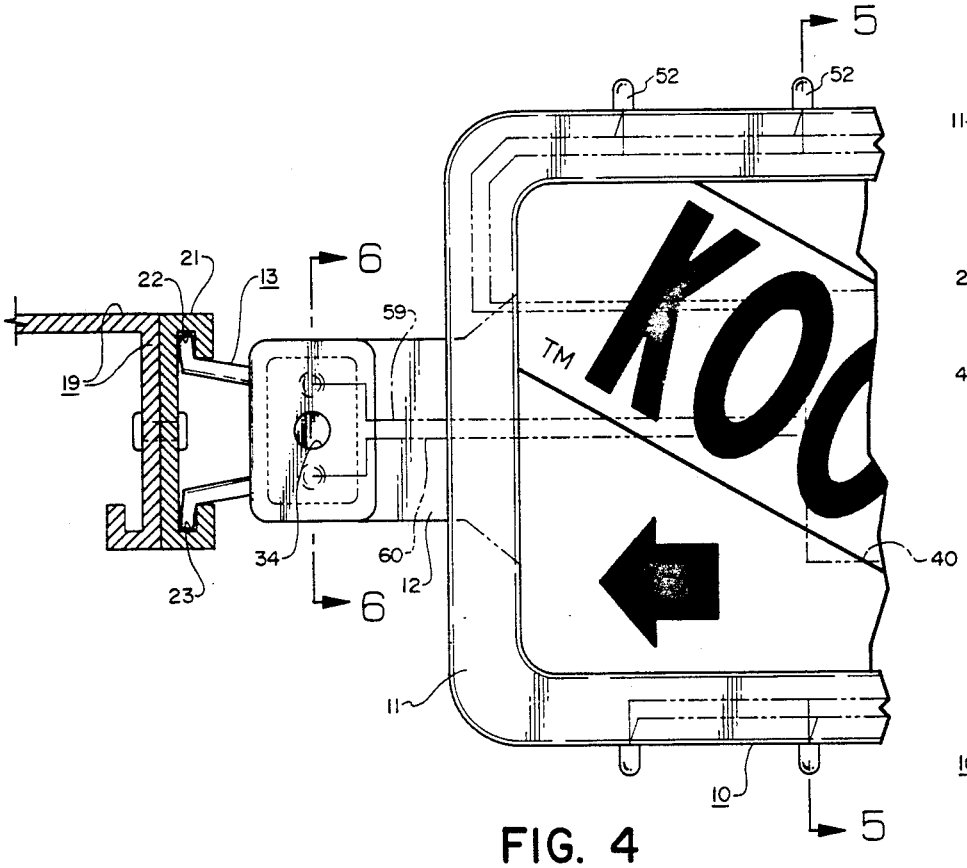
FIG. 4 is an elevation taken along the arrow 4 in FIG. 1.
Figure 5:
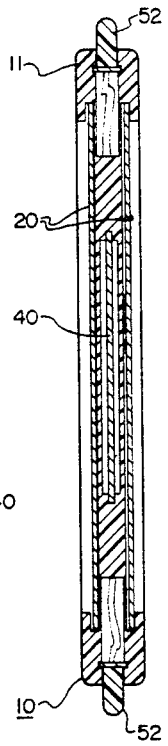
FIG. 5 is a vertical transverse section taken along the line 5—5 in FIG. 4.

In FIG. 1 advertising or merchandising display device 10 comprises a panel 11, a resilient, flexible tongue 12 integral therewith, and a mounting bracket or clip 13. The panel 11 has a peripheral edge 14 which is contiguous with frame portions 15 at opposite sides of the panel, the frame portions comprising respective peripheral margins 16 at opposite sides of panel 11. Panel 11 includes also a central portion 17 that serves as a backing for a pair of display cards 18, by way of example, which may be contained in respective pockets 19 and 20 in panel 11. Small interior detents as at 20A can be employed to aid in keeping the advertising cards in place. The tab portion or tongue at 12 is designed to be flexible and may be comprised of a coil spring, a resilient, flexible metallic rubber or resilient plastic member, and so forth, this to insure that any jarring of the panel as produced by the movement of a shopping cart, will not destroy the display device but will rather allow it to give in the direction of motion of the cart such that when the cart passes the display device will spring back to its normal, perpendicular condition relative to the shelf edge of the display shelf.

Figure 6:
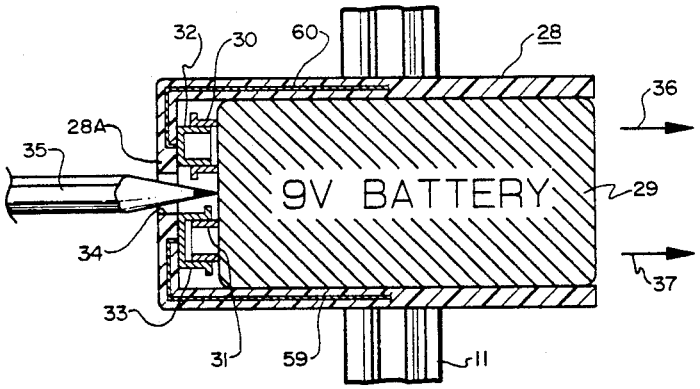
FIG. 6 is an enlarged section detail taken along the lines 6—6 in FIG. 4.

The display shelf 19 is customarily made of metal and has a forward lip 20 which is vertical in orientation. The lip 20 serves as a backing for channel 21. The channel 21 includes upper and lower channel slots 22 and 23, each of which receive a respective foot portion 24 and 25 of upper and lower legs 26 and 27. Legs 26 and 27 form integral portions of, and comprise flanges of the composite mounting clip 13. Battery container 28 is secured to tongue portion 12 by any conventional means and is also made integral, preferably, with mounting clip 13. The battery container 28 is shown in greater detail in FIG. 6 wherein a nine volt battery, by way of example, is included at 29, having its battery terminals 30 and 31 engaging electrical connections 32 and 33, respectively, of the battery housing or container 28. The left end of battery container 28A is closed off excepting for a central aperture 34, designed to receive an implement such as a pencil 35 which can be used to eject the battery 29 from its container 28 in the direction of arrows 36 and 37. A series of rivets 38 can be employed to secure the channel 21 directly to the front lip or portion 20 of the display shelf 19; FIG. 1 shows the display shelf as containing a series of cans or other containers at 39, the display device 10 being employed to draw the attention of shoppers to particular specials or other advertising information relative to such goods at 39.

Comparison of FIGS. 1 and 4 indicate that different types of signs may be employed concurrently in the respective forward and rear pockets 19 and 20 of the display device, see also FIG. 3.

Figure 7:
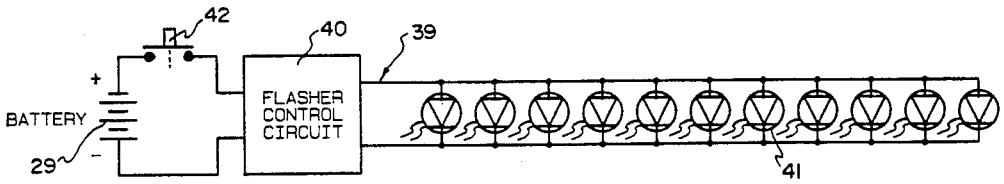
FIG. 7 is a schematic diagram of a representative electrical circuit that can be employed in conjunction with the subject advertising display device.
Figure 8:
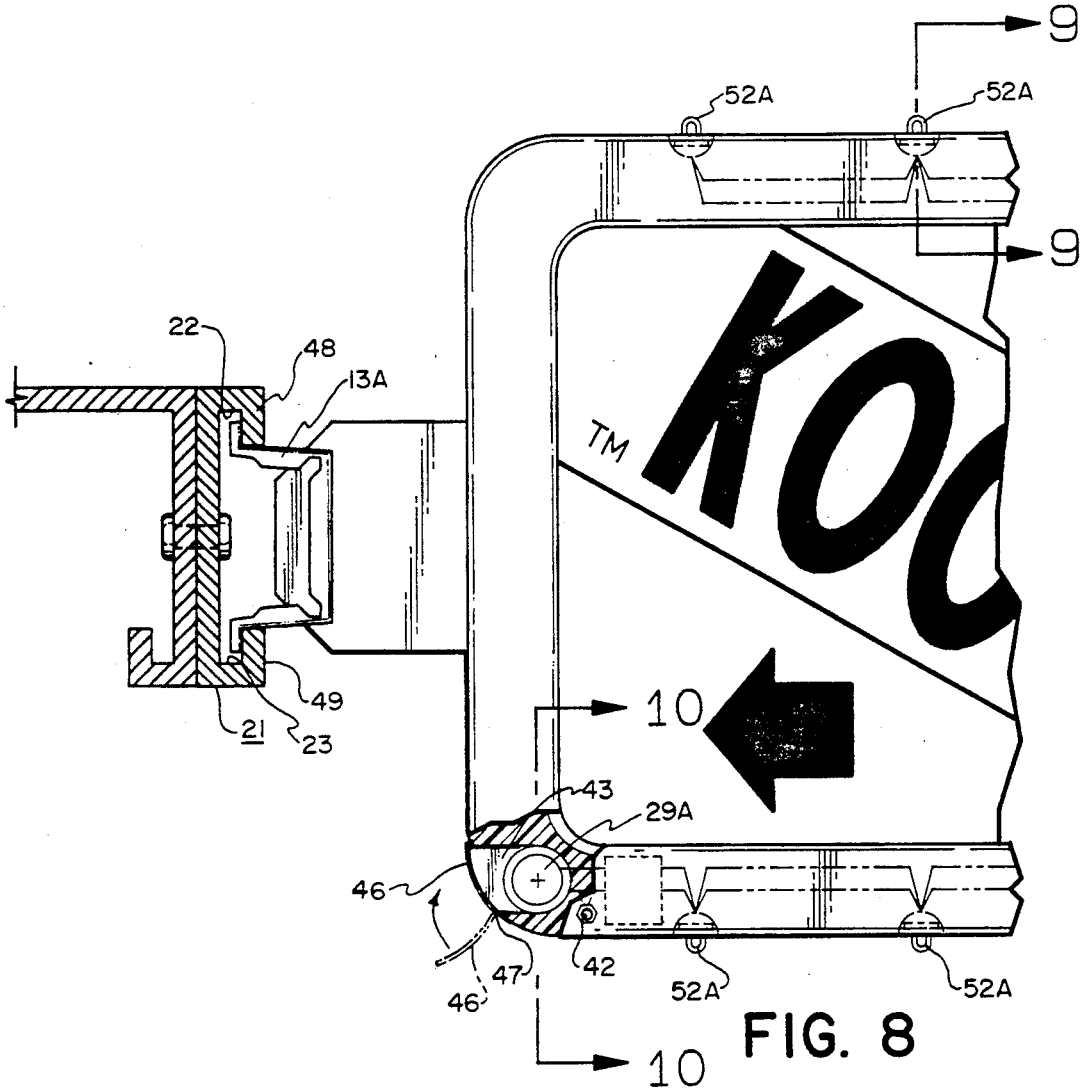
FIG. 8 is similar to FIG. 4 but illustrates this time that the display device can contain in its frame directly the electrical circuit means including its battery.
Figure 10:
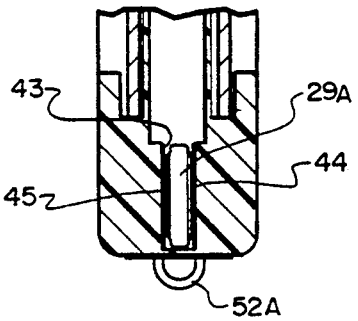
FIG. 10 is an enlarged vertical section taken along the line 10—10 in FIG. 8.

A circuit which may be employed in the display device 10 is shown as circuit 39 in FIG. 7. The same includes battery 29 and, with the same, a flasher control circuit 40 as well as a series of lights 41 such as parallel connected LEDs (light emitting diodes). A push button on/off switch 42 is preferably included in the circuit, see FIG. 7 and also FIGS. 1 and 10. An optional way of including the battery in the structure is shown in FIG. 8, wherein a disc-type battery 29A is simply dropped into slot 43, engages electrical connections 44 and 45 leading to the lighting circuit, and wherein the slot 43 is permissibly covered by a cover 46 that is hinged or pivoted at 47 in FIG. 8. The inclusion of the battery at 29A in FIG. 8, corresponding to battery 29 in FIGS. 6 and 7, will this time power the circuit, leaving the mounting clip 13A corresponding to mounting clip 13 in the other figures free of battery inclusion; instead, the legs and feet may be designed simply to spring outwardly, as is also the case with mounting clip 13, to engage the upper and lower channel portions 48 and 49 of channel 21, see FIGS. 1 and 8.

For most types of grocery shelves that are presently used, and which do include, generally, the channel 21, the upper and lower flanges of the mounting clip 13, comprising upper and lower legs 26 and 27 with their respective feet, will be made resilient such that the legs can be depressed inwardly so that the outer ends of the feet can slip past the upper and lower lips of the channels such that these legs can spring outwardly, with the feet engaging slots 22 and 23.

If desired, the clip and the battery container, with an exposed portion of the tab 12, may be plastic encased for protection purposes.

FIG. 1A illustrates that panel 11A, corresponding to panel 11 in FIG. 1, may include simply a single slot 50 that can receive a display card 51 containing advertising indicia on both sides, by way of example.

Figure 9:
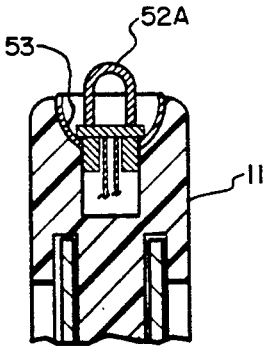
FIG. 9 is an enlarged fragmentary section taken along the line 9—9 in FIG. 8.

The several lights 41, 52 may comprise, again, light emitting diodes or LEDs, or any other type of light. Included is the concept of employing HID (high intensity discharge) lights which customarily comprise U-shaped tubes having suitable terminal and filled with xenon gas. Other types of gases such as argon, etc., may be employed. Typical xenon HID lights may be employed and are shown at 52A in FIGS. 8 and 9. These, or other lights can include parabolic or other concave reflectors as at 53, which may be either integrally formed with the panel 11 or comprise separate elements tending to concentrate light emissions from the various light elements. The lights themselves are preferably electrically connected together in parallel and, to prolong battery life, an on/off switch as at 42 can be employed. In the structure shown it is preferable that there be two pockets on either side of the central portion of the panel, these pockets containing their respective cards which can be inserted from the tab or clip side of the device, the tongue or tab portion 12 being bondable and resilient, so that the cards are not exposed to inadvertent vandalism or withdrawal by young shoppers.

It will of course be understood that the device of the present invention, see the fragmentary cross-sectional view of FIG. 2A, may be used in conjunction with display shelves where the shelves themselves are close to but separated by passersby by means of a glass or plastic door 53 of a refrigerated display cabinet 54. The cabinet may include shelves 55 and 56, and the display device 10 this time includes a plastic or even a metal channel length 57 that can simply be glued or otherwise secured at surface 58 to the door 53. Accordingly, the display device will highlight the contents of the cabinet, yet the door can be opened in customary fashion so that the shopper achieves easy access to the shelves.

Where the battery and battery container form a portion of or are contained by the mounting clip 13 and the same made integral with tongue or tab portion 12, then it is preferred that the electrical wire leads from the battery as at 59 and 60 be actually encased in the tongue or tab portion. In this way the wire leads are protected from passersby, yet, their nature permits their flexing with tab portion or tongue in response to inadvertent movement of display device 10.

Accordingly, what the present invention offers is an at- or proximate shelf mechandising display device which is illuminated, battery powered, and which serves to draw attention to a variety of store goods. The battery is either self-contained in the panel of the display device or is encased within the clip used to mount the flexible tongue of such device to a forward lip channel associated with a given store shelf.

Rather than, or in addition to plural lights, the subject advertising panel may include battery powered, electrically energized alpha-numeric, liquid crystal or other display indicia, as is conventional with various battery-powered readouts in watches, etc., on the market. Again, the invention is suitable not only for shelves per se, but also for frozen food cabinets, refrigerators, freezers and the like.

It will be obvious to those skilled in the art that changes and modifications may be made in the present invention without departing from its essential aspects and, therefore, the object of the claims which follow is to cover all such changes and modifications as fall within the true spirit and scope of this invention.

I claim:

1. An at-shelf lighted merchandising display, including, in combination, a panel having opposite faces defined by peripheral margins surrounding viewing openings, said panel also being provided with pockets contiguous with and communicating with said viewing openings, display cards bearing advertising indicia and removably disposed in said pockets, said panel also including a central portion defining inner sides of said pockets and having a flexible outwardly extending tab portion, a mounting clip secured to said tab portion and constructed to releasably engage the outer edge of an external display shelf, the combination of said panel and mounting clip being provided with an electrical circuit comprising a series of lights and a battery selectively coupled to said lights, said panel including a slot, said battery being disposed in said panel slot, and a cover is attached to said panel to cover said slot.

2. An at-shelf lighted merchandising display, including, in combination, a panel having opposite faces defined by peripheral margins surrounding viewing openings, said panel also being provided with pockets contiguous with and communicating with said viewing openings, display cards bearing advertising indicia and removably disposed in said pockets, said panel also including a central portion defining inner sides of said pockets and having a flexible outwardly extending tab portion, a mounting clip secured to said tab portion and constructed to releasably engage the outer edge of an external display shelf, the combination of said panel and mounting clip being provided with an electrical circuit comprising a series of lights and a battery selectively coupled to said lights, and wherein said mounting clip includes a battery container provided with battery connections coupled to said electrical circuit, said battery being disposed in said battery container and having terminals respectively releasably connected to said connections, said battery container also having an open rear end to accommodate battery removal and a forward end providing an implement admitting aperture whereby an external implement may be thrust through said aperture to urge a battery contained in said battery container to disconnect from said connections and to proceed out of said container.

3. The structure of claim 2 wherein the combination of said tab, mounting clip and battery container are plastic encased, leaving exposed said battery case rear end and said implement admitting aperture.

* * * * *